US008561849B1

(12) United States Patent
Wang

(10) Patent No.: US 8,561,849 B1
(45) Date of Patent: Oct. 22, 2013

(54) FOAM SPRAY HEAD ASSEMBLY

(76) Inventor: Ya-Tsan Wang, HsinChu (TW)

( * ) Notice: Subject to any disclaimer, the term of this patent is extended or adjusted under 35 U.S.C. 154(b) by 19 days.

(21) Appl. No.: 13/481,877

(22) Filed: May 28, 2012

(51) Int. Cl.
*B67D 7/76* (2010.01)

(52) U.S. Cl.
USPC ..... 222/190; 222/145.5; 222/189.06; 222/189.09; 222/321.7; 222/321.8; 222/321.9

(58) Field of Classification Search
USPC ..... 222/190, 321.2, 321.9, 319, 320, 321.1, 222/321.7, 321.8, 189.02, 189.03, 189.04, 222/189.06, 189.08, 145.1, 145.5, 145.6, 222/189.09
See application file for complete search history.

(56) References Cited

U.S. PATENT DOCUMENTS 5,570,819 A * 11/1996 Uehira et al. ..... 222/190
6,142,338 A * 11/2000 Pellicano ..... 222/1
6,299,028 B1 * 10/2001 Iizuka et al. ..... 222/190
6,536,629 B2 * 3/2003 van der Heijden ..... 222/190
7,201,293 B2 * 4/2007 Iizuka et al. ..... 222/145.6
7,401,714 B2 * 7/2008 Iizuka et al. ..... 222/145.6
7,611,033 B2 * 11/2009 Ganzeboom ..... 222/190
7,757,899 B2 * 7/2010 van der Heijden ..... 222/190
8,079,497 B2 * 12/2011 Brouwer ..... 222/153.13
8,109,415 B2 * 2/2012 Tu ..... 222/190
8,336,737 B2 * 12/2012 Van Der Heijden ..... 222/145.3
8,376,190 B2 * 2/2013 Choi et al. ..... 222/190

* cited by examiner

*Primary Examiner* — Frederick C Nicolas
*Assistant Examiner* — Bob Zadeh

(57) ABSTRACT

A foam spray head assembly includes a push head, a mounting member, a netted member, an air valve, a main plunge, a piston unit, a rod unit, a resilient member, a cylinder unit and a valve. The netted member has a first net and a second net. The air valve has a first groove and a second groove. The main plunge has a first plunge and a second plunge. The first plunge is located in the second groove and defines a first chamber. The piston unit has a first piston and a second piston. The rod unit extends through the main plunge. The resilient member is mounted to the second plunge. The cylinder unit has a first cylinder and a second cylinder. The first piston is movable in the first cylinder and forms a second chamber. The second piston is movable in the second cylinder and forms a third chamber.

10 Claims, 7 Drawing Sheets

FOAM SPRAY HEAD ASSEMBLY

BACKGROUND OF THE INVENTION (1) Field of the Invention

The present invention relates to a spray head assembly, and more particularly, to a spray head assembly that sprays foams directly.

(2) Description of the Prior Art

The conventional detergent bottle has a resilient push head which sucks the detergent in the bottle. For some special needs, such as the foam-type detergent such as shampoo and dish-washing detergent, the detergent is sucked by the suction device and sprayed on the user hands, the hands are scrubbed to generate foams. However, the amount the detergent is different to control and the exceeded amount of the detergent left on the skin or the kitchen wares may be harmful to the users.

The development of a foam spray head unit for generating foams directly is needed by the manufacturers.

SUMMARY OF THE INVENTION

The present invention relates to a foam spray head assembly and comprises a push head connected with a mounting member. A netted member has a hollow tube and two ends of the hollow tube are respectively connected with a first net and a second net. An air valve has a first groove and a second groove. The air valve has the first end thereof connected to the first net and mounted to the push head. The second end of the air valve is connected with the second net. A main plunge is a hollow tube and has a first plunge, a second plunge, a flange portion and a lip. The first plunge is located in the second groove and defines a first chamber. A first gap is defined between the outer surface of the first plunge and the n inner surface of the second groove.

A piston unit has a hollow first piston and a second piston. The first piston has a third groove, a fourth groove and a seal ring. An intake slot is defined between the top end of the fourth groove and the inner surface of the first groove. A second gap is defined between the bottom end of the fourth groove and the flange portion. The seal ring movably contacts the lip of the main plunge. The second piston has a fifth groove and a sixth groove. The second piston is connected to the second plunge.

A rod unit extends through the main plunge and has a first rod, a second rod and a connection portion. The first rod is connected to the second rod by the connection portion. The first rod has an annular flange on the first end thereof which is movably in contact with the inner surface of the first plunge. The second rod extends through the second piston. The second rod and the sixth groove are located in the second plunge. A third gap is defined between the rod unit and the inner surface of the second plunge.

A resilient member is mounted to the second plunge and has an end contacting the flange portion.

A cylinder unit is connected to the mounting member and has a first cylinder and a second cylinder. A ring is located between the first and second cylinders. The first piston is movable in the first cylinder and forms an enclosed second chamber. The second piston is movable in the second cylinder and forms an enclosed third chamber. A valve is in contact with an opening of the second cylinder.

The resilient member is mounted to the second plunge and the liquid passes through the hollow path in the second plunge so that the liquid is not contaminated because it is not in contact with other chemical liquid.

The third groove of the first piston is movable and in contact with the first cylinder so as to form the enclosed second chamber, and the fifth groove of the second piston is movable and in contact with the second cylinder so as to form the enclosed third chamber. The present invention provides better sealing feature when compared with the conventional ones, and the efficiency of suction effect is increased.

The first and second nets are directly connected to the air valve and then connected to the push head, the number of parts required is reduced.

The netted member has a hollow tube and two ends of the hollow tube are respectively connected to the first and second nets so as to generate different types of foams.

The first and second nets are made by way of injection molding, and the two nets are engaged with the two ends of the hollow tube to avoid the two nets from dropping or loosing.

The first and second nets have hexagonal apertures to generate fine foams.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
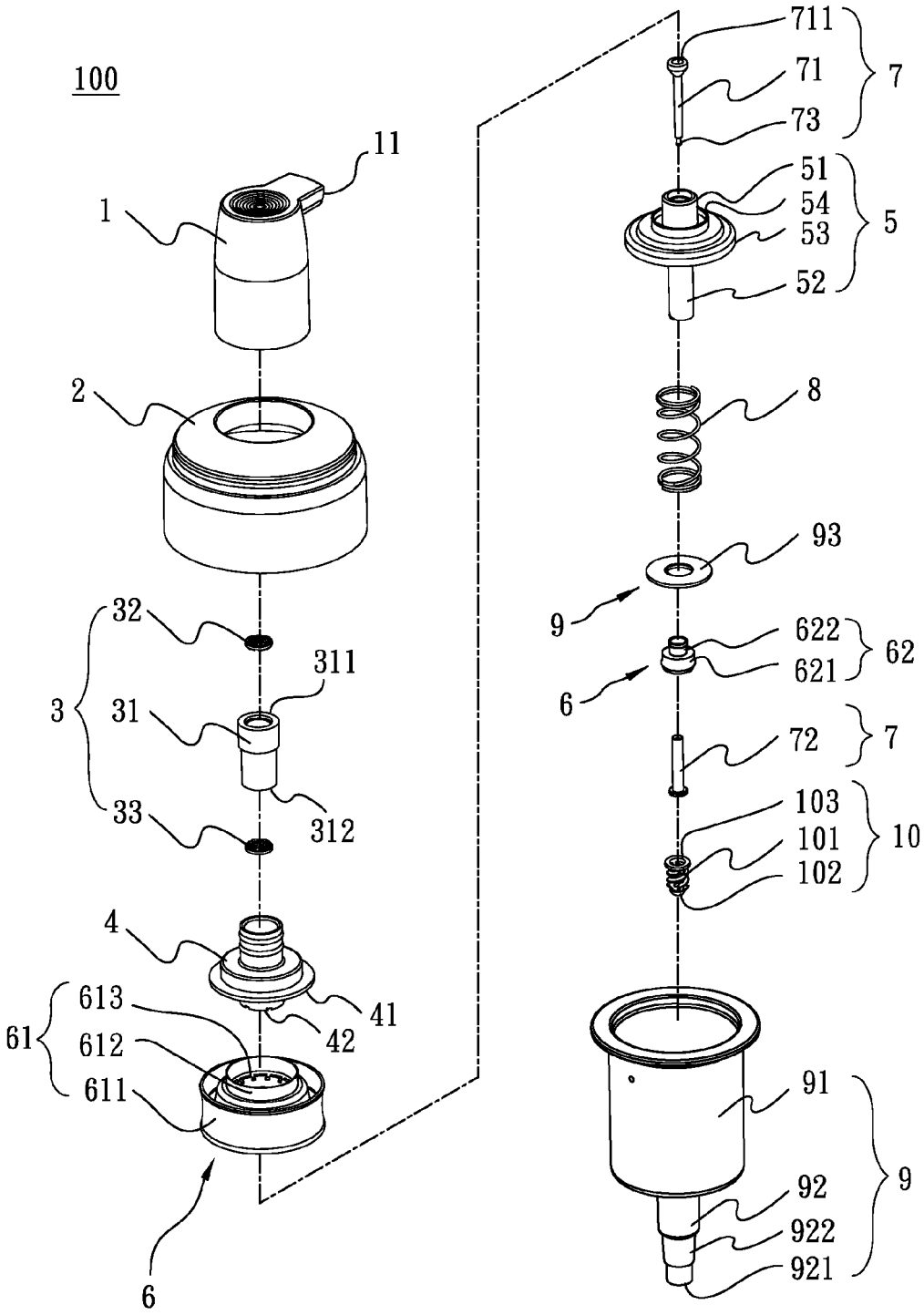
FIG. 1 is an exploded view to show the foam spray head assembly of the present invention.

Referring to FIG. 1, the foam spray head assembly 100 of the present invention comprises a push head 1, a mounting member 2, a netted member 3, an air valve 4, a main plunge 5, a piston unit 6, a rod unit 7, a resilient member 8, a cylinder unit 9 and a valve 10.

Figure 8:
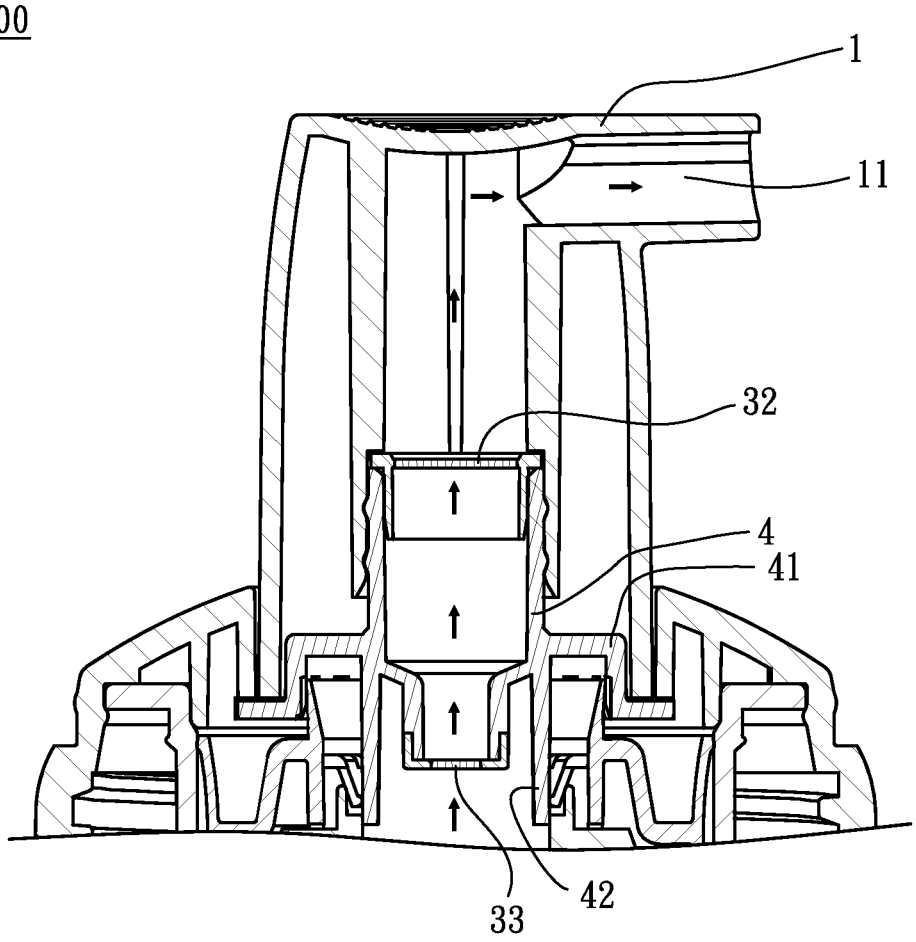
FIG. 8 is yet another cross sectional view of the push head of the foam spray head assembly of the present invention.

The push head 1 has an outlet 11 so that the foam is sprayed from the outlet 11. The push head 1 is connected with the mounting member 2. The mounting member 2 has a threaded section which is threadedly connected to a bottle. The netted member 3 has a first net 32 and a second net 33. The air valve 4 has a first groove 41 and a second groove 42. The air valve 4 has the first end thereof connected to the first net 32 and mounted to the push head 1, the second end of the air valve 4 is connected with the second net 33 as shown in FIG. 8.

In this embodiment, the netted member 3 has a hollow tube 31 which has a first end 311 and a second end 312. The first net 32 and the second net 33 are respectively located on the first and second ends 311, 312 of the hollow tube 31. The hollow tube 31 is mounted to the air valve 4.

Figure 2:
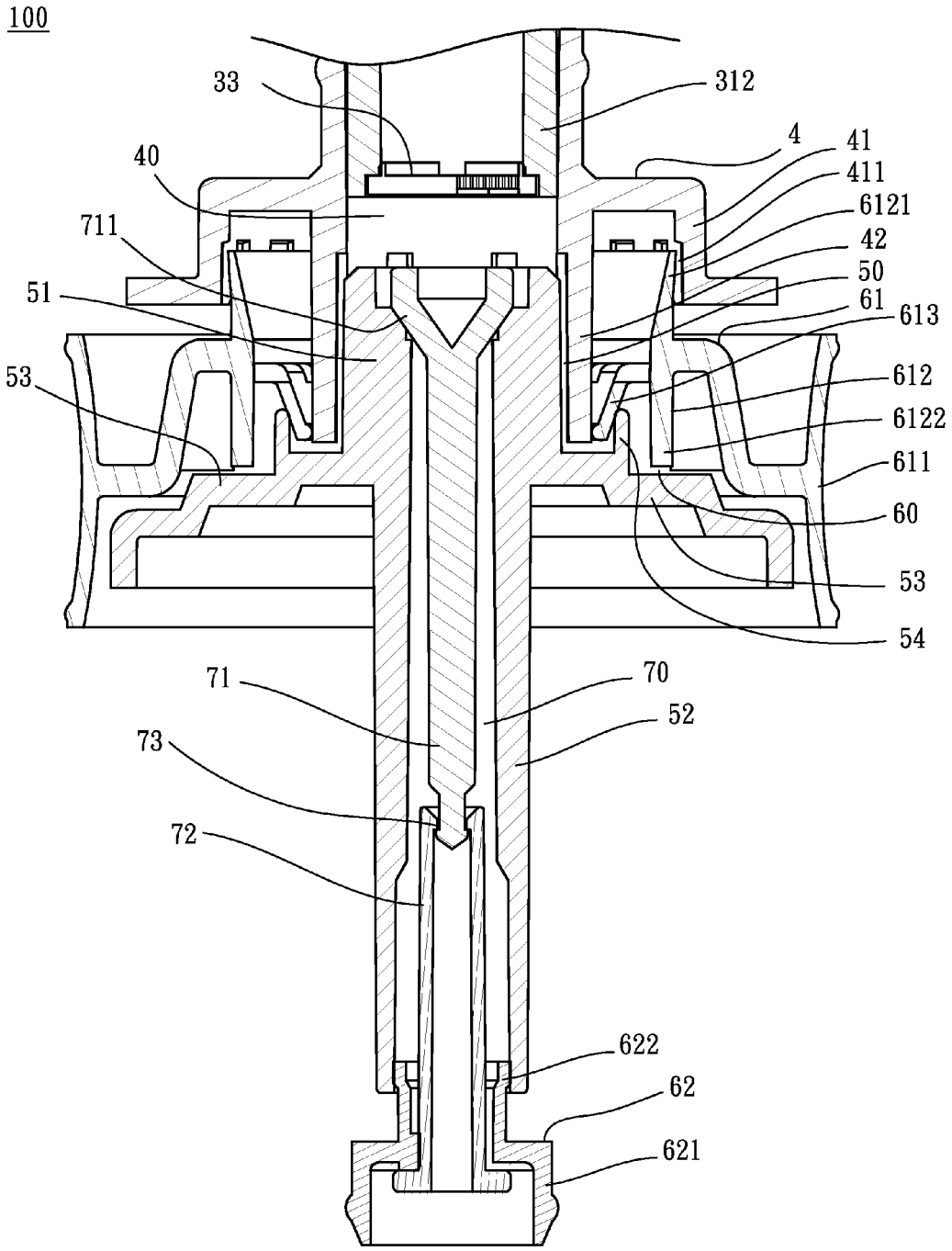
FIG. 2 is a cross sectional view of the foam spray head assembly of the present invention.

The main plunge 5 is a hollow tube and has a first plunge 51, a second plunge 52, a flange portion 53 and a lip 54. Referring to FIG. 2, the first plunge 51 is located in the second groove 42 and defines a first chamber 40 in the second groove 42. The first plunge 51 is smaller than the second groove 42. A first gap 50 is defined between the outer surface of the first plunge 51 and the inner surface of the second groove 42.

The piston unit 6 has a hollow first piston 61 and a second piston 62. The first piston 61 has a third groove 611, a fourth groove 612 and a seal ring 613. An intake slot 411 us defined between the top end 6121 of the fourth groove 612 and the inner surface of the first groove 41. A second gap 60 is defined between the bottom end 6122 of the fourth groove 612 and the flange portion 53. The seal ring 613 movably contacts the lip 54 of the main plunge 5. The second piston 62 has a fifth groove 621 and a sixth groove 622. The second piston 62 is connected to the second plunge 52 by the sixth groove 622.

The rod unit 7 extends through the main plunge 5 and has a first rod 71, a second rod 72 and a connection portion 73. The first rod 71 is connected to the second rod 72 by the connection portion 73. The first rod 71 has an annular flange 711 on the first end thereof and which is movably in contact with the inner surface of the first plunge 51. The second rod 72 extends through the second piston 62, and the second rod 72 and the sixth groove 622 are located in the second plunge 52. The outer diameter of the rod unit 7 is smaller than the inner diameter of the second plunge 52. A third gap 70 is defined between the rod unit 7 and the inner surface of the second plunge 52.

Figure 3:
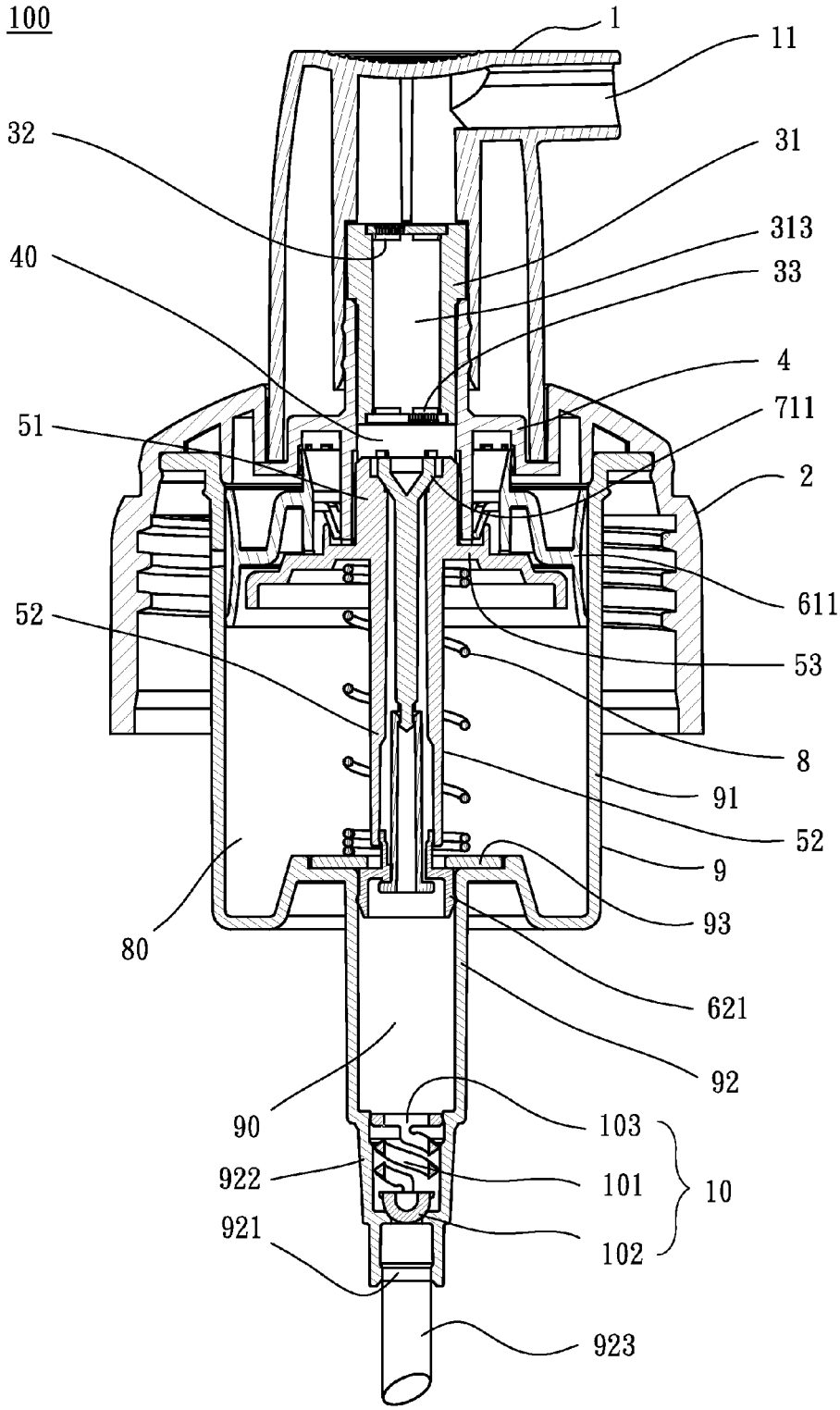
FIG. 3 is another cross sectional view of the foam spray head assembly of the present invention.

Referring to FIG. 3, the resilient member 8 is mounted to the second plunge 52 and has an end contacting the flange portion 53. The cylinder unit 9 is connected to the mounting member 2 and has a first cylinder 91 and a second cylinder 92. A ring 93 is located between the first and second cylinders 91, 92. The other end of the resilient member 8 contacts the ring 93. In this embodiment, the first cylinder 91 is larger than the second cylinder 92, the first piston 61 is larger than the second piston 62. The third groove 611 of the first piston 61 is movable and in contact with the inner surface of the first cylinder 91 so as to form an enclosed second chamber 80 in the first cylinder 91. The fifth groove 621 of the second piston 62 is movable and in contact with the inner surface of the second cylinder 92 so as to form an enclosed third chamber 90.

The valve 10 is in contact with an opening 921 of the second cylinder 92. A hose 923 is connected with the opening 921 so as to suck the liquid in the bottle. In this embodiment, the valve 10 is a spiral valve and the opening 921 is opened and closed when the valve 10 moves upward and downward respectively. The second cylinder 92 has a suction path 922 in which the valve 10 is received. The valve 10 has a resilient and hollow threaded portion 101. The valve 10 has a stop 102 which faces and seals the opening 921. The valve 10 has a passage 103 which faces the second cylinder 92.

Figure 4:
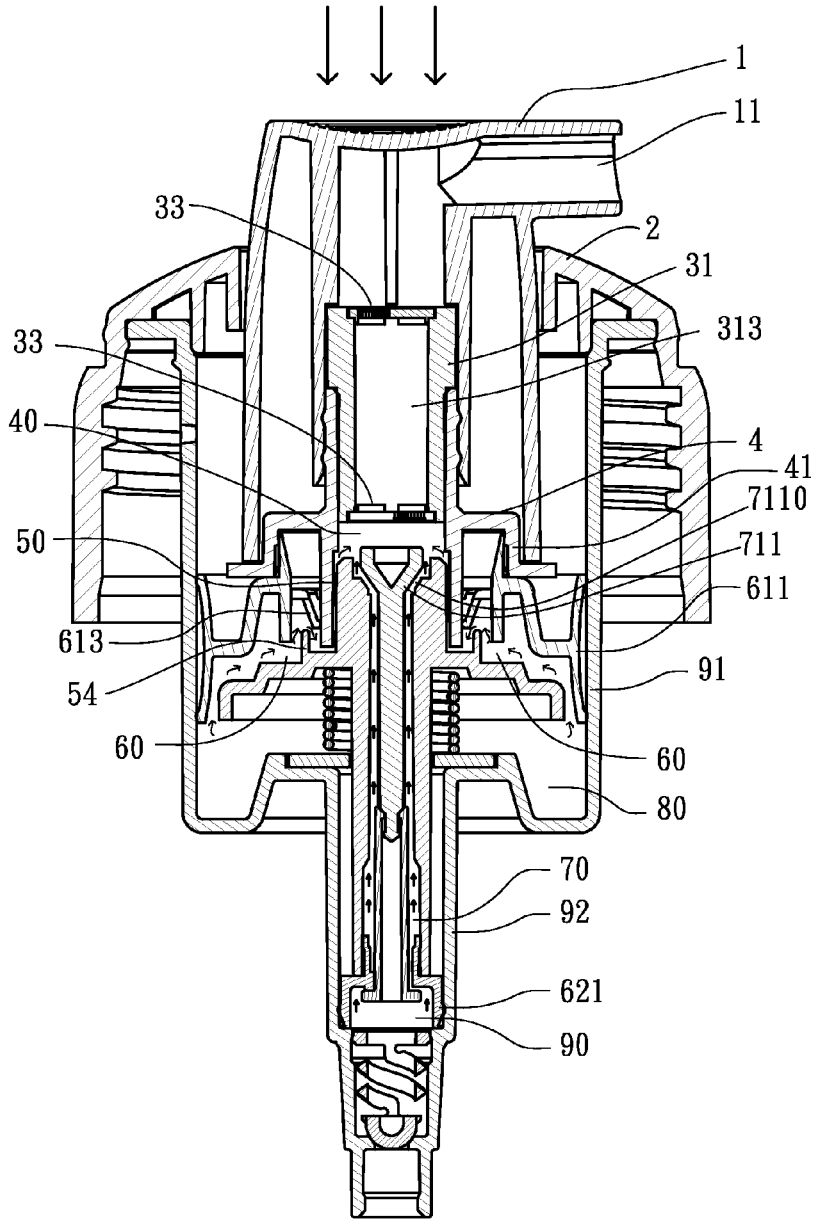
FIG. 4 is yet another cross sectional view of the foam spray head assembly of the present invention.

Referring to FIG. 4, when pushing the push head 1 downward, the air valve 4 and the main plunge 5 are moved downward, and the third groove 611 of the first piston 61 and the fifth groove 621 of the second piston 62 are stopped due to the friction from the inner surfaces of the first cylinder 91 and the second cylinder 92. In this status, the second rod 72 of the rod unit 7 stops the downward movement of the first rod 71 so that the annular flange 711 of the first rod 71 is removed from the inner surface of the first plunge 51 so as to form a fourth gap 7110. The liquid in the third chamber 90 flows into the first chamber 40 via the third and fourth gaps 70, 7110.

Besides, the intake slot 411 of the air valve 4 is gradually closed, the seal ring 613 is gradually removed from the lip 54 of the main plunge 5 to open the passage from which is air is released. The air in the second chamber 80 of the cylinder unit 9 enters into the first chamber 40 via the first gap 50 during the continuously pushing of the push head 1. The air is nixed with the liquid in the chamber 40, the combination of the liquid and air passes through the second net 33 and the first net 32 and generates foams which is released from the outlet 11 of the push head 1.

When releasing the push head 1, due to the bouncing force from the resilient member 8, the air valve 4 and the main plunge 5 are moved upward, and the third groove 611 of the first piston 61 and the fifth groove 621 of the second piston 62 are stopped due to the friction from the inner surfaces of the first cylinder 91 and the second cylinder 92. In this status, the second rod 72 of the rod unit 7 stops the upward movement of the first rod 71 so that the annular flange 711 of the first rod 71 is in contact with the inner surface of the first plunge 51 so as to seal the fourth gap 7110. The intake slot 411 of the valve unit 4 is gradually opened and the seal ring 613 gradually contacts the lip 54 of the main plunge 5 to seal lip 54. Along with the continuous upward movement of the main plunge 5, the first piston 51, the rod unit 7 and the second piston 52 move upward, so that the second chamber 80 and the third chamber 90 are increased and the outside air is sucked into the second chamber 80 via the intake slot 411. The liquid enters into the third chamber 90 via the valve 10 and ready for next spray.

It is noted that the resilient member 8 is mounted to the outer surface of the second plunge 52 and the liquid passes through the hollow passage in the second plunge 52 so that the liquid is not contaminated because it is not in contact with other chemical liquid or the resilient member 8.

The third groove 611 of the first piston 61 is movable and in contact with the inner surface of the first cylinder 91 so as to form the enclosed second chamber 80 in the first cylinder 91. The fifth groove 621 of the second piston 62 is movable and in contact with the inner surface of the second cylinder 92 so as to form an enclosed third chamber 90. The present invention provides better sealing feature when compared with the conventional ones, and the efficiency of suction effect is increased.

Figure 5:
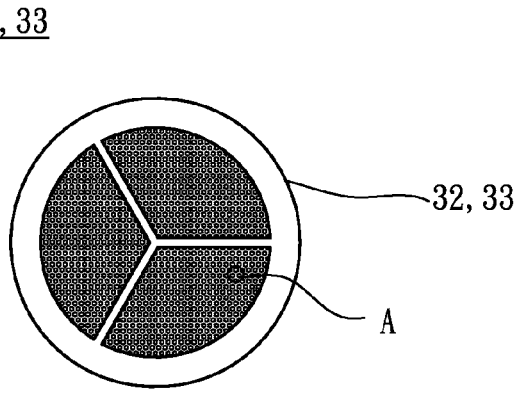
FIG. 5 shows the first net and the second net of the foam spray head assembly of the present invention.
Figure 5A:
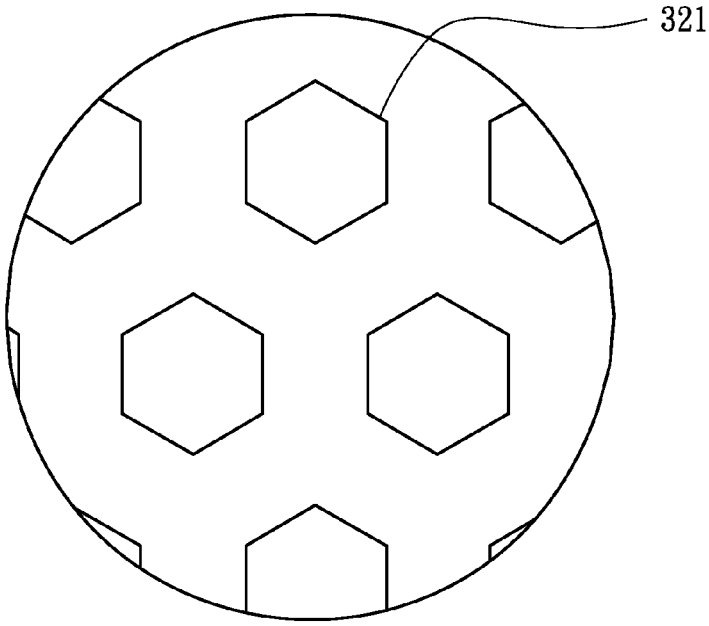
FIG. 5A is an enlarge view of the disclosure of FIG. 5.

As shown in FIGS. 5 and 5A, the first net 32 or the second net 33 are made by way of injection molding so that they are directly connected to the two ends of the hollow tube without worry of dropping or loosening. The first and second nets 32, 33 have hexagonal apertures 321 to generate fine foams. The apertures 321 of the first net 32 are smaller or equal to apertures 321 of the second net 33, wherein a foam buffering space 313 is defined in the hollow tube 31 so that when the liquid and air pass through the second nets 33 with larger apertures 321, the foams are buffered in the foam buffering space 313, and then pass through the first net 32 with smaller apertures 321 to generate fine foams.

Figure 6:
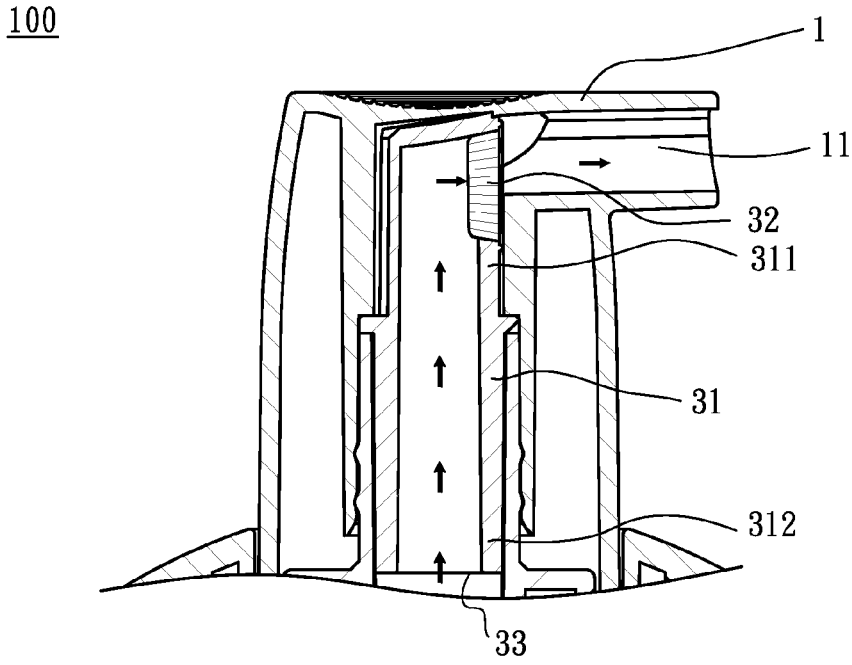
FIG. 6 is a cross sectional view of the push head of the foam spray head assembly of the present invention.

The netted member 3 may have only the first and second nets 32, 33 which are directly connected to the air valve 4 as shown in FIG. 8, the number of parts required is reduced. When the netted member 3 has the hollow tube 31, the way that the first and second nets 32, 33 are connected to the hollow tube 31 is not limited. As shown in FIG. 6, the first end 311 of the hollow tube 31 that faces the outlet 11 has the first net 32 connected thereto, and the second net 33 is connected to the second end 312 of the hollow tube 31. The first net 32 is more close to the outlet 11 so that the travel distance of the foams is shortened and the foams are well maintained.

Figure 7:
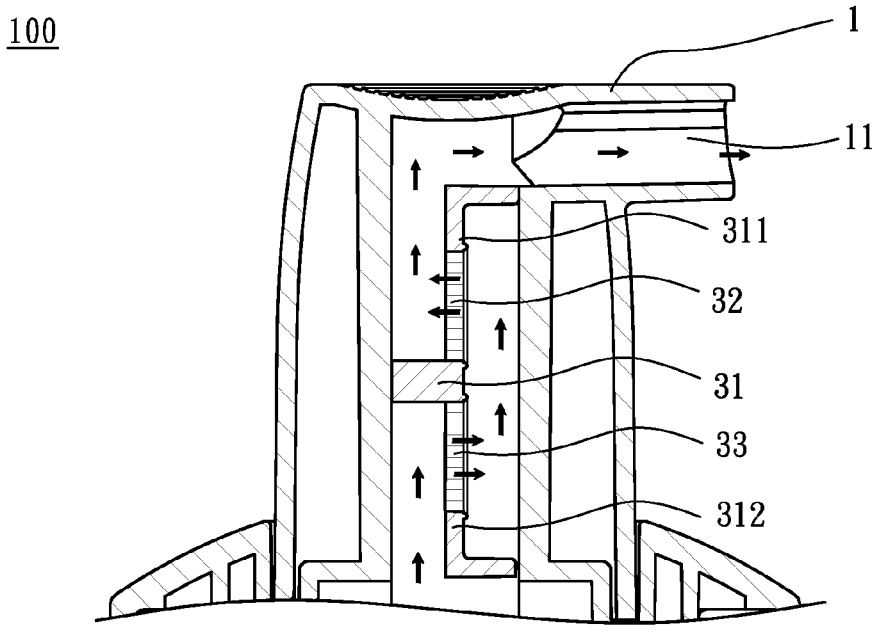
FIG. 7 is another cross sectional view of the push head of the foam spray head assembly of the present invention.

As shown in FIG. 7, the first end 311 of the hollow tube 31 is connected with the first net 32, and the second net 33 is connected to the mediate portion of the second end 312 of the hollow tube 31. When the liquid and air pass through the netted member 3 via the first chamber 40, the air and liquid pass through the second net 33 via the second end 312 of the hollow tube 31, and then pass through the first net 32, and then the air and the liquid is released from the outlet 11 via the first end 311 of the hollow tube 31. By the connection of the first net 32 connected to the first end 311 of the hollow tube and the second net 33 connected to the second end 312 of the hollow tube 31, different paths for the foams are formed.

While we have shown and described the embodiment in accordance with the present invention, it should be clear to those skilled in the art that further embodiments may be made without departing from the scope of the present invention.

What is claimed is:

1. A foam spray head assembly comprising:

a push head connected with a mounting member;

a netted member having a first net and a second net;

an air valve having a first groove and a second groove, the air valve having a first end thereof connected to the first net and mounted to the push head, a second end of the air valve connected with the second net;

a main plunge being a hollow tube and having a first plunge, a second plunge, a flange portion and a lip, the first plunge located in the second groove and defining a first chamber, a first gap defined between an outer surface of the first plunge and an inner surface of the second groove;

a piston unit having a hollow first piston and a second piston, the first piston having a third groove, a fourth groove and a seal ring, an intake slot defined between a top end of the fourth groove and an inner surface of the first groove, a second gap defined between a bottom end of the fourth groove and the flange portion, the seal ring movably contacting the lip of the main plunge, the second piston having a fifth groove and a sixth groove, the second piston connected to the second plunge;

a rod unit extending through the main plunge and having a first rod, a second rod and a connection portion, the first rod connected to the second rod by the connection portion, the first rod having an annular flange on a first end thereof and the annular flange movably in contact with an inner surface of the first plunge, the second rod extending through the second piston, the second rod and the sixth groove located in the second plunge, a third gap defined between the rod unit and an inner surface of the second plunge;

a resilient member mounted to the second plunge and having an end contacting the flange portion;

a cylinder unit connected to the mounting member and having a first cylinder and a second cylinder, a ring located between the first and second cylinders, the first piston movable in the first cylinder and forming an enclosed second chamber, the second piston movable in the second cylinder and forming an enclosed third chamber, and a valve being in contact with an opening of the second cylinder.

2. The assembly as claimed in claim 1, wherein the valve is a spiral valve and the opening is opened and closed when the valve moves upward and downward respectively.

3. The assembly as claimed in claim 2, wherein the second cylinder has a suction path in which the valve is received, the valve has a resilient and hollow threaded portion, the valve has a stop which faces and seals the opening, the valve has a passage which faces the second cylinder.

4. The assembly as claimed in claim 1, wherein the netted member has a hollow tube which has a first end and a second end, the first net and the second net are connected to the hollow tube, the hollow tube is mounted to the air valve.

5. The assembly as claimed in claim 1, wherein apertures of the first net are smaller or equal to apertures of the second net.

6. The assembly as claimed in claim 1, wherein the hollow tube of the netted member has a buffering space.

7. The assembly as claimed in claim 1, wherein the first net or the second net is made by way of injection molding.

8. The assembly as claimed in claim 1, wherein the first net and/or the second net have hexagonal apertures.

9. The assembly as claimed in claim 1, wherein the mounting member has a threaded section which is threadedly connected to a bottle.

10. The assembly as claimed in claim 1, wherein the opening of the cylinder unit is connected with a hose.

* * * * *